US012509907B2

(12) United States Patent
Lo et al.

(10) Patent No.: US 12,509,907 B2
(45) Date of Patent: Dec. 30, 2025

(54) VERTICAL POST STRUCTURE OF FENCE

(71) Applicant: Xia Shin International Co., Ltd., Tainan (TW)

(72) Inventors: Eric Chen Zer Lo, Tainan (TW); Chin Hung Hsu, Tainan (TW)

(73) Assignee: Xia Shin International Co., Ltd., Tainan (TW)

( * ) Notice: Subject to any disclaimer, the term of this patent is extended or adjusted under 35 U.S.C. 154(b) by 0 days.

(21) Appl. No.: 18/764,767

(22) Filed: Jul. 5, 2024

(65) Prior Publication Data

US 2025/0092714 A1 Mar. 20, 2025

(30) Foreign Application Priority Data

Sep. 19, 2023 (TW) ..... 112135732
Jan. 18, 2024 (TW) ..... 113101981
Jun. 21, 2024 (TW) ..... 113123271

(51) Int. Cl.
*E04H 17/14* (2006.01)

(52) U.S. Cl.
CPC ..... *E04H 17/1447* (2021.01)

(58) Field of Classification Search
CPC ..... E04H 17/1413; E04H 17/1447; E04H 17/1452; E04H 17/1456; E04H 17/1488; E04H 17/16; E04H 17/1602; E04H 17/165; E04H 17/168; E04H 17/17; E04F 11/1853; E04F 2011/1819; E04F 2011/1831; E04F 2011/1887; E04F 2011/1895
USPC ..... 256/24, 65.01, 65.02
See application file for complete search history.

(56) References Cited

U.S. PATENT DOCUMENTS 3,770,245 A * 11/1973 Murdock ..... E04F 11/1851 256/65.08
4,007,919 A * 2/1977 Totten ..... E04H 17/1413 256/65.13
4,809,955 A * 3/1989 Veilleux ..... E04H 17/1447 256/65.02
5,702,090 A * 12/1997 Edgman ..... E04H 17/1426 256/65.02
6,283,456 B1 * 9/2001 Benz ..... E04H 17/163 256/73
6,546,675 B1 * 4/2003 Adderton ..... E04B 2/7435 52/282.1

(Continued)

FOREIGN PATENT DOCUMENTS

CN 103422713 A 12/2013
CN 217326791 U 8/2022
DE 102014005717 A1 * 10/2014 ..... E04F 11/1812

*Primary Examiner* — Amber R Anderson
*Assistant Examiner* — Zachary A Hall
(74) *Attorney, Agent, or Firm* — Best & Flanagan LLP

(57) ABSTRACT

A vertical post structure of a fence comprises an axial slot on at least one side of a post, and an axial notch at an end of the slot facing the post. An inner wall of the slot and the two sides near to the notch extend obliquely to form a clamping board, wherein a tail end of the clamping board has a buckle part. Each buckle part is positioned within the projection range of the notch, and a plate is fixed with a stop end of the post and corresponds to the slot. The buckle parts directly clip and buckle the end parts of the cross bars to fix them to the post, or the post can be assembled with the cross bars fixed inside the slot and to a base, and the plate prevents separation of the cross bars from the post.

8 Claims, 7 Drawing Sheets

(56) References Cited

U.S. PATENT DOCUMENTS

| | | | | |
|---|---|---|---|---|
| 6,884,002 | B1 * | 4/2005 | Fuller | E02B 7/22 52/282.1 |
| 7,434,790 | B1 * | 10/2008 | Hansen | E04F 11/1851 52/235 |
| 7,730,677 | B2 * | 6/2010 | Hansen | E01F 8/0017 52/204.593 |
| 9,476,221 | B2 * | 10/2016 | Marshall | E04H 17/17 |
| 11,746,559 | B2 * | 9/2023 | Amsellem | E06B 11/02 256/34 |
| 2024/0141686 | A1 * | 5/2024 | Schneider | E04H 17/168 |

* cited by examiner

VERTICAL POST STRUCTURE OF FENCE

BACKGROUND OF THE INVENTION

The present invention relates to a vertical post structure of a fence, and more particularly to the vertical post configured with two buckle parts capable of clipping and buckling the ends of the cross bars to fix; or via a connecting base fixed inside the combining slot and further via the connecting base connected to the cross base, the vertical post can be easily assembled with the cross bars having various materials.

DESCRIPTION OF THE RELATED ART

Accordingly, the fence is primarily used in a courtyard and balcony, comprising at least two vertical posts having bottom ends implanted into the ground and one or a plurality of cross bars located between the two vertical posts. The prior-art connection between the vertical posts and the cross bars are mostly via the screw pieces as described in Taiwan Patent No. I831726 entitled "STRUCTURAL IMPROVEMENT OF SIDE POST OF FENCE" filed by the applicant (namely, the side post is referred to as the vertical post in the present invention). An assembly using the screw pieces will spend a lot of time. Moreover, when connecting the vertical post with the cross bars having different materials (for example, the cross bar can be made of aluminum, wood or glass), the structure of the vertical post needs to be changed accordingly.

In view of the above-mentioned deficiency in the application of the prior-art fence, the inventor of the present invention made effort to improve the structure and finally developed the present invention.

SUMMARY OF THE INVENTION

It is a primary objective of the present invention to provide a vertical post structure of a fence for easy assembly and enabling the cross bars having different materials to be connected.

The primary feature of the present invention is to install a combining slot extending axially on at least one side of a vertical post and an outside end of the combining slot facing the vertical post is also provided with a notch extending axially, an inner wall of the combining slot and the two sides near to the notch are respectively extending obliquely toward the interior of the combing slot and projection range of the notch to form a clamping board, wherein a tail end of the clamping board is configured with a buckle part, an elastic clamping force is defined between the two buckle parts and the two buckle parts are positioned within the projection range of the notch, and an upper stop plate is fixed with a stop end of the vertical post and corresponding to the combining slot. Accordingly, when the cross bars are combined with the vertical post, the two buckle parts are used to directly clip and buckle the end parts of the cross bars to fix, or the vertical post can be assembled with the cross bars having difference materials via a connecting base fixed inside the combining slot and further via connecting the connecting base to the cross bars, and the upper stop plate enables to prevent the cross bars to be forced to separate from the vertical post.

Other features and advantages of the present invention will become apparent from the following description of the invention which refers to the accompanying embodiments and drawings.

DETAILED DESCRIPTION OF EMBODIMENTS OF THE INVENTION

With reference to FIGS. 1~4, a fence 1 according to an embodiment of the invention comprises at least two vertical posts 10 and one or a plurality of the cross bars 20, and the two ends of the cross bars 20 are connected to the vertical post 10.

Figure 4:
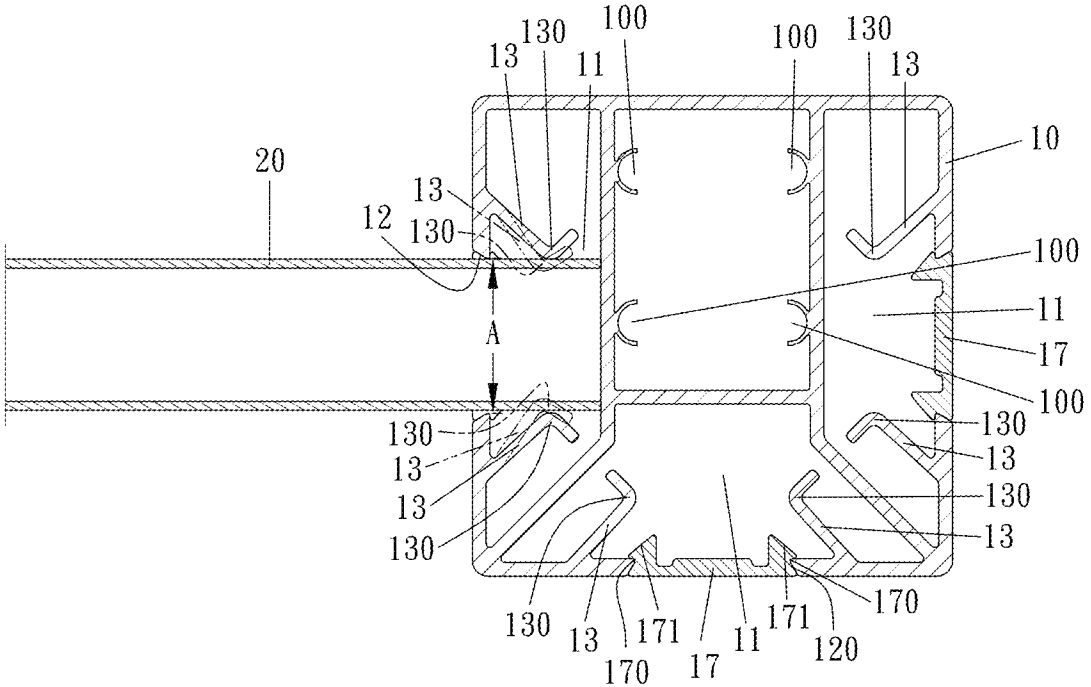
FIG. 4 is a section top view of a combination of FIG. 3.

A combining slot 11 extending axially is configured on the side of the vertical post 10 facing a connecting end of the cross bar 20, a notch 12 extending axially is configured at an outer side of the combining slot 11 facing a connecting end of the cross bar 20 and the horizontal width of the notch 12 matches the cross bar 20; an inner wall of the combining slot 11 and the two sides near to the notch 12 are individually extending obliquely toward the interior of the combing slot 11 and toward a projection range A of the notch 12 to form a clamping board 13 (as shown in FIG. 4), wherein the clamping boards 13 are arranged at right and left and the tail ends thereof are provided with a buckle part 130, an elastic clamping force is existing between the two buckle parts, and the two buckle parts 130 are positioned inside the projection range A of the notch 12 (as shown in FIG. 4). The configuration of the two buckle parts 130 enables the end part of the cross bar 20 to reach into the combining slot 11 via the notch 12 and then the two buckle parts 130 clip and buckle the outer walls of the cross bars 20 to position.

Figure 1:
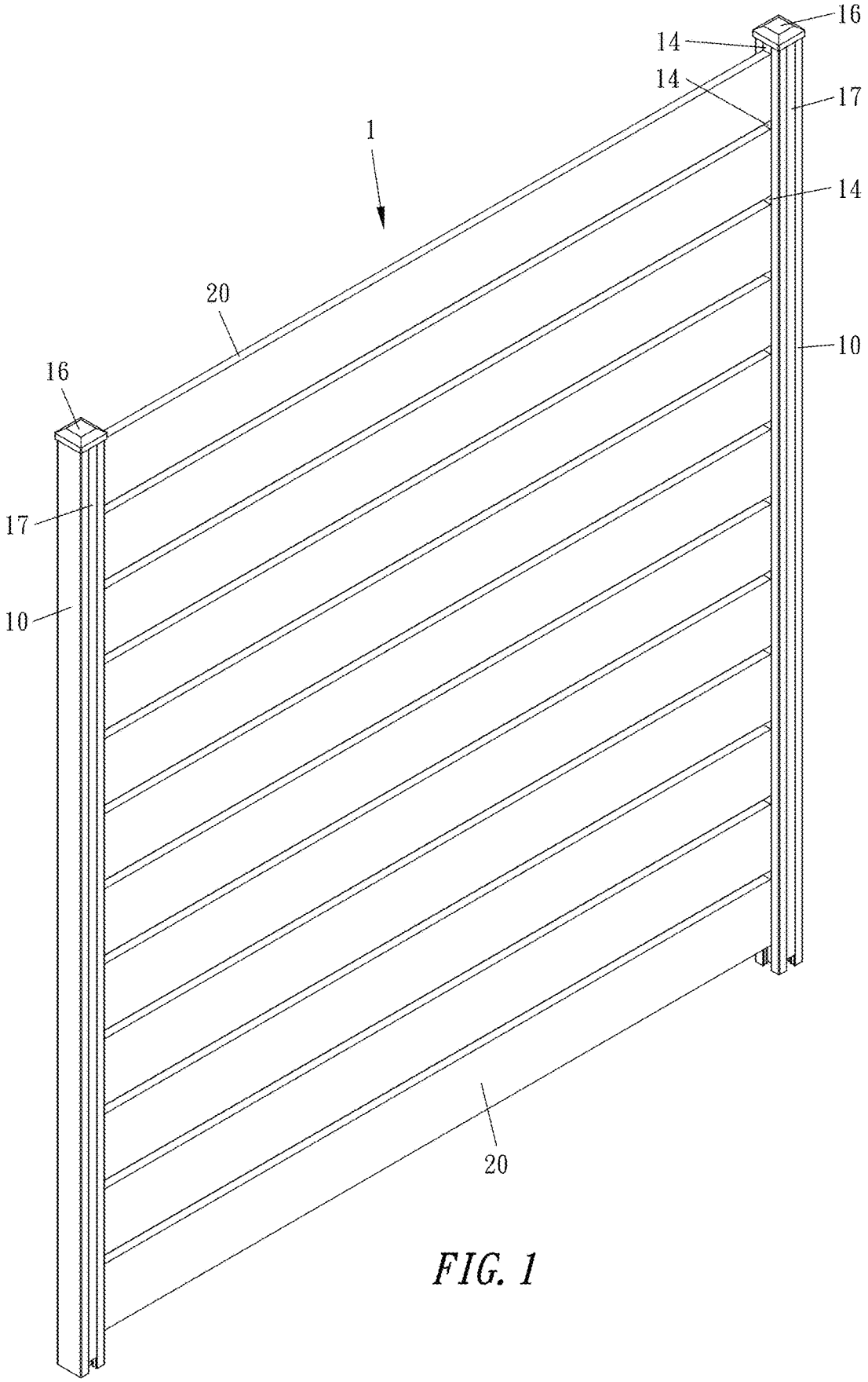
FIG. 1 is a perspective view of an embodiment of the present invention.
Figure 2:
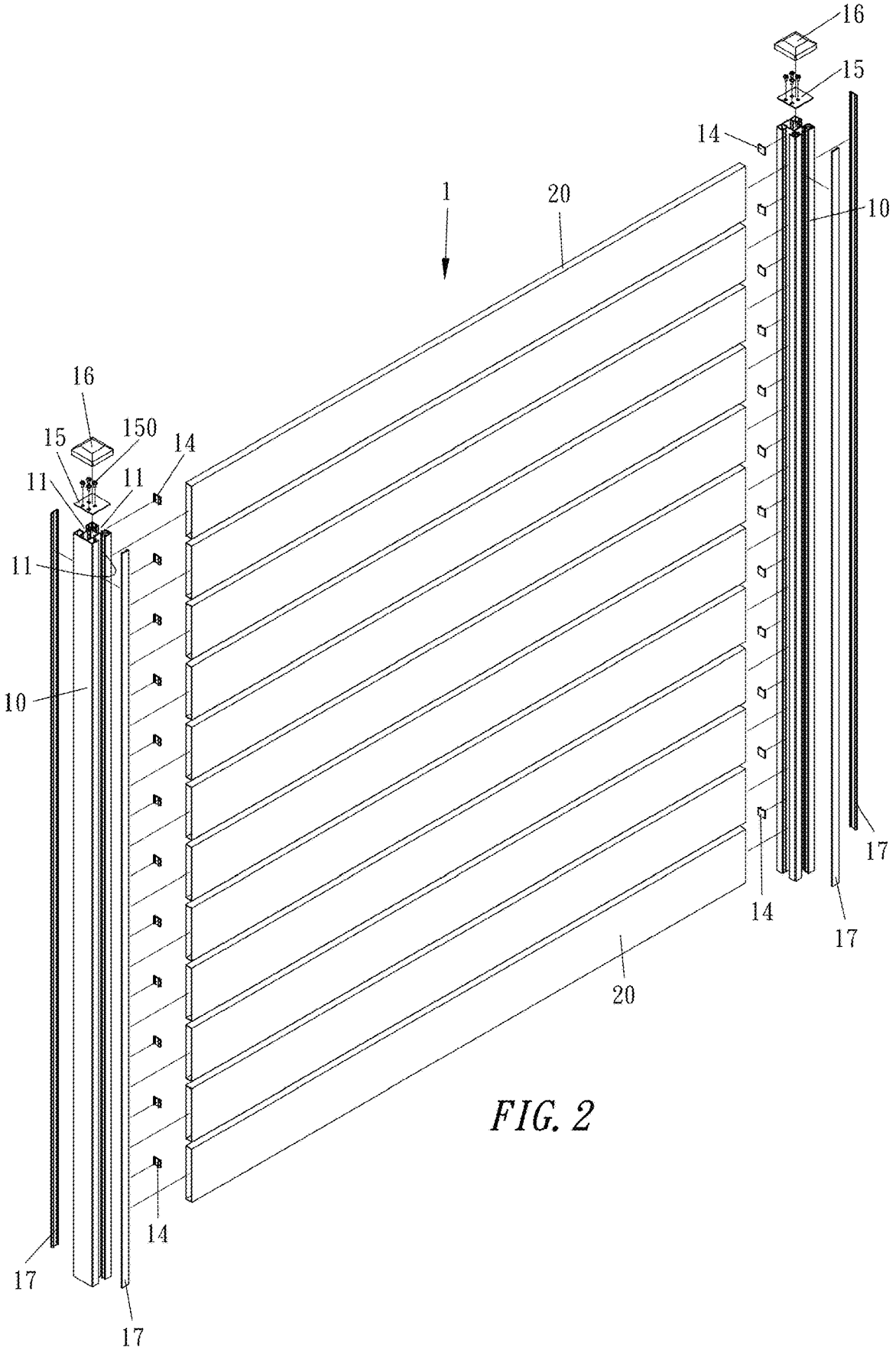
FIG. 2 is an exploded view of an embodiment of the present invention.
Figure 3:
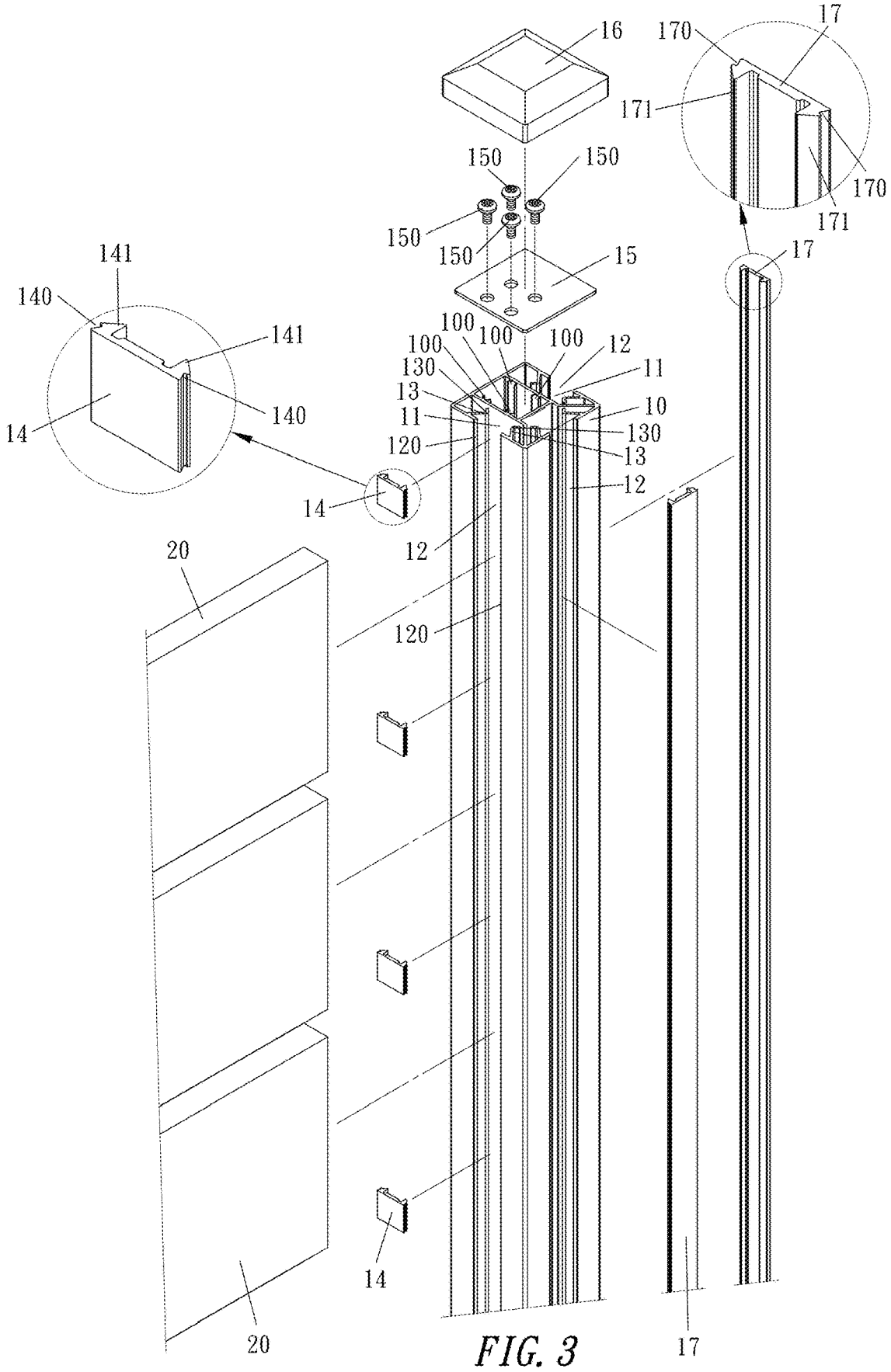
FIG. 3 is a partial exploded view of an embodiment of the present invention.

A spacer plate 14 (as shown in FIG. 3) is fixedly combined with the notch 12 and defined between each two cross bars 20 to be used as a longitudinal supporting point of the cross bars 20 and covering the notch 12. The spacer plate 14 and the notch 12 are fixed through a clipping recess 140 with a concave shape configured at the outer wall of the right and left sides of the space plate 14 matching the open edge 120 of the notch 12, the front ends of the two clipping recesses 140 are configured with an inclined taper surfaces 141, and when the spacer plate 14 is combined and positioned with the notch 12, the taper surfaces 141 go across the opening edge 120 of the notch 12 and then enable the opening edges 120 to engage in the clipping recess 140, thereby fixing the spacer plate 14 on the notch 12.

An upper stop plate 15 (as shown in FIG. 3) is defined on the top end of the vertical post 10 and screwed and fixed with a preset thread hole 100 on the top end of the vertical post 10 via a screw piece 150 (see FIG. 3). The coverage of the upper stop plate 15 covers a projection area of the combining slot 11 so that the upper stop plate 15 can block the cross bar 20 when the cross var 20 is applied a force to be upward, thereby avoiding the cross bar 20 to separate from the vertical post 10. The top end of the vertical post 10 above the upper stop plate 15 can be fixed with a decorative cover 16 to decorate the top end of the vertical post 10 and cover the upper stop plate 15.

When the cross bar 20 is combined with the vertical post 10, the spacer plate 14 is firstly fixed on the notch 12 below the position where the vertical post 10 is combined with the lowermost cross bar 20, and then the end part of the cross bar 20 is pushed into the combining slot 11 through the notch 12 to contact the inner wall of the combining slot 11. During the process of the end part of the cross bar 20 penetrating into the combining slot 11, the bar wall of the cross bar 20 push the two corresponding buckle parts 130 outward via a horizontal pushing force, and when the cross bar 20 reaches to be positioned, the two buckle parts 130 clamp and position the left and right walls of the cross bar 20 with an elastic clamping force. Meanwhile, the bottom end of the cross bar 20 is supported and positioned by the top end of the spacer plate 14. The next cross bar 20 is also combined in a manner of the above-mentioned assembly, namely, a spacer plate 14 is firstly fixed on the notch 12 above the lower cross bar 20, and then the cross bar 20 is pushed into the combining slot 11 and across the spacer plate 14 to be positioned. And so on, to assemble the cross bars 20, till the uppermost cross bar 20 is combined with the vertical post 10, the upper stop plate 15 and the decorative cover 16 are fixed on the top end of the vertical post 10 via the screw pieces 150, and therefore the cross bar 20 and the vertical post 10 are assembled completely.

Figure 5:
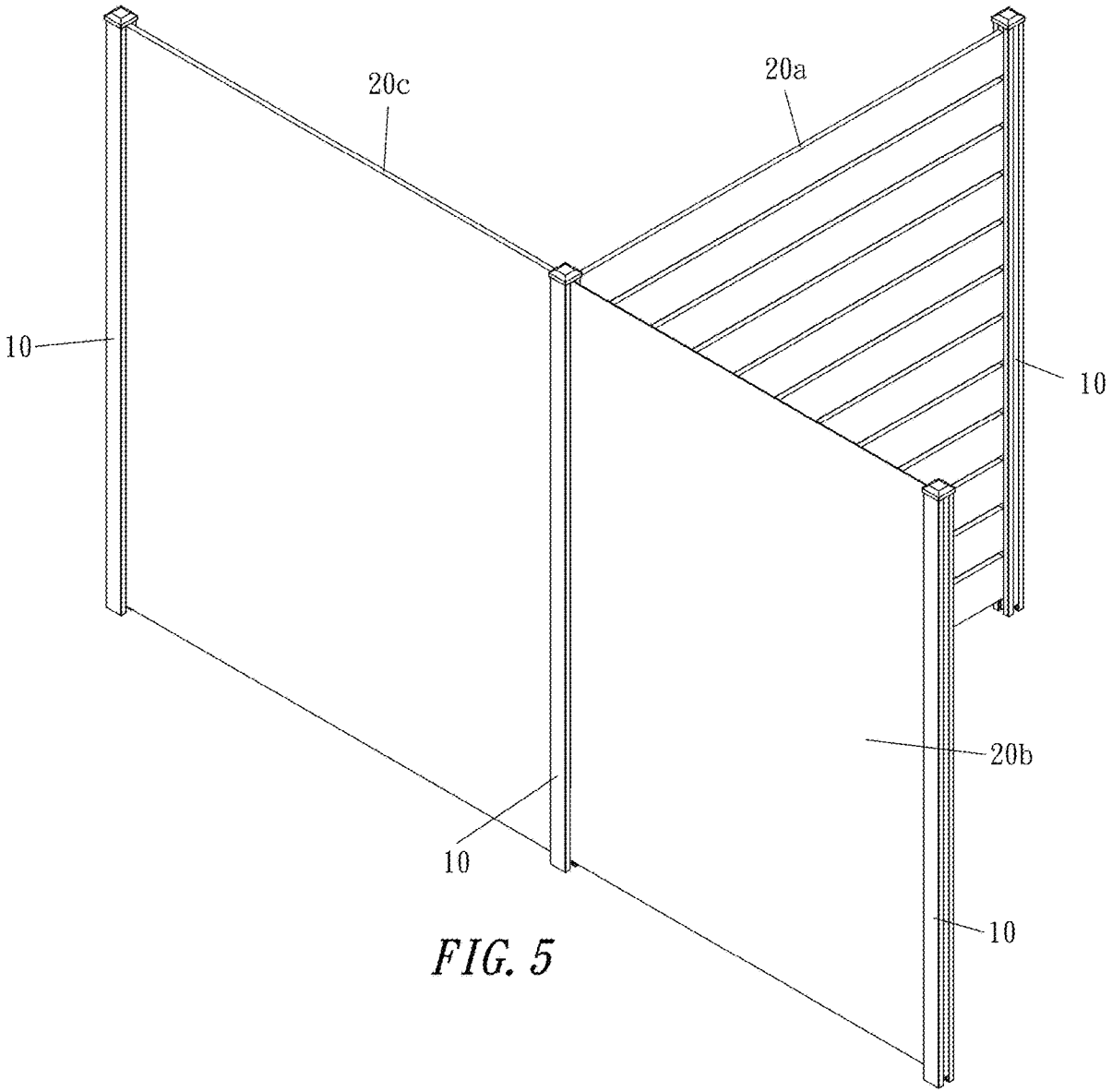
FIG. 5 is a perspective view of an embodiment applied to a fence in a T-shaped arrangement.
Figure 6:
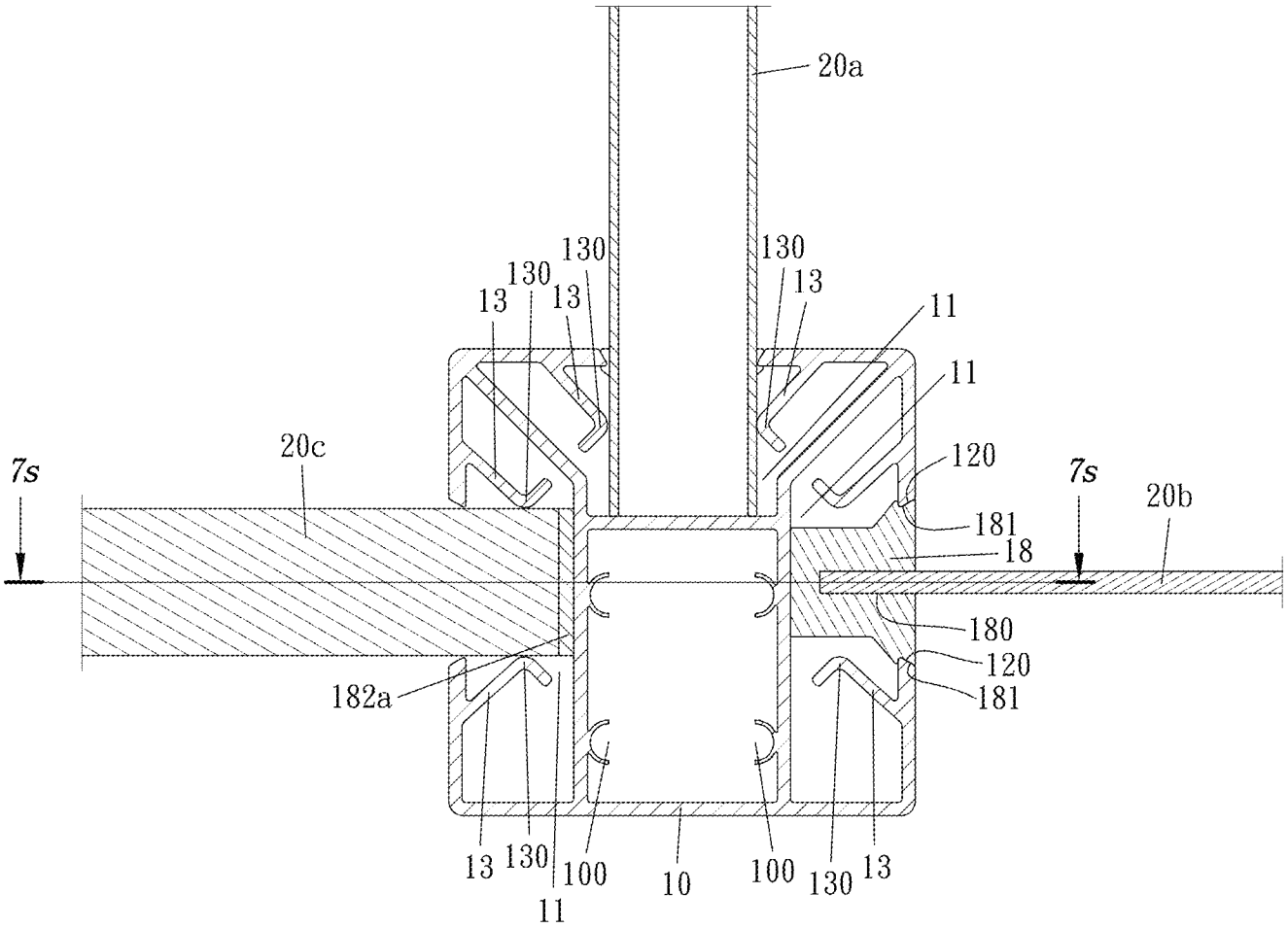
FIG. 6 is a partial section view of FIG. 5.

Further, besides on one side of the vertical post 10, the combing slot 11 and the notch 12 are configured on the two opposite sides of the vertical post 10 (provide a fence in linear arrangement to use) or the three sides of the vertical post 10 at 90-degree angular intervals are respectively configured with the combining slots 11 and the notches (provide a fence in T-shaped arrangement to use, as shown in FIGS. 5, 6), so that one vertical post 10 can be used according to the different needs. The unused notch 12 can be covered by a covering plate 17 (as shown in FIGS. 1 to 4). The structure of the covering plate 17 is the same as the spacer plate 14 and the length is long enough to cover the whole notch 12. The left and right side walls of the covering plate 17 matching the opening edges 120 of the notch 12 are configured with a concave clipping recess 170, wherein the front ends of the two clipping recesses 170 are configured with an inclined taper surface 171 clamping to be fixed with the opening edges 120 of the notch 12 via the clipping recess 170.

Figure 7:
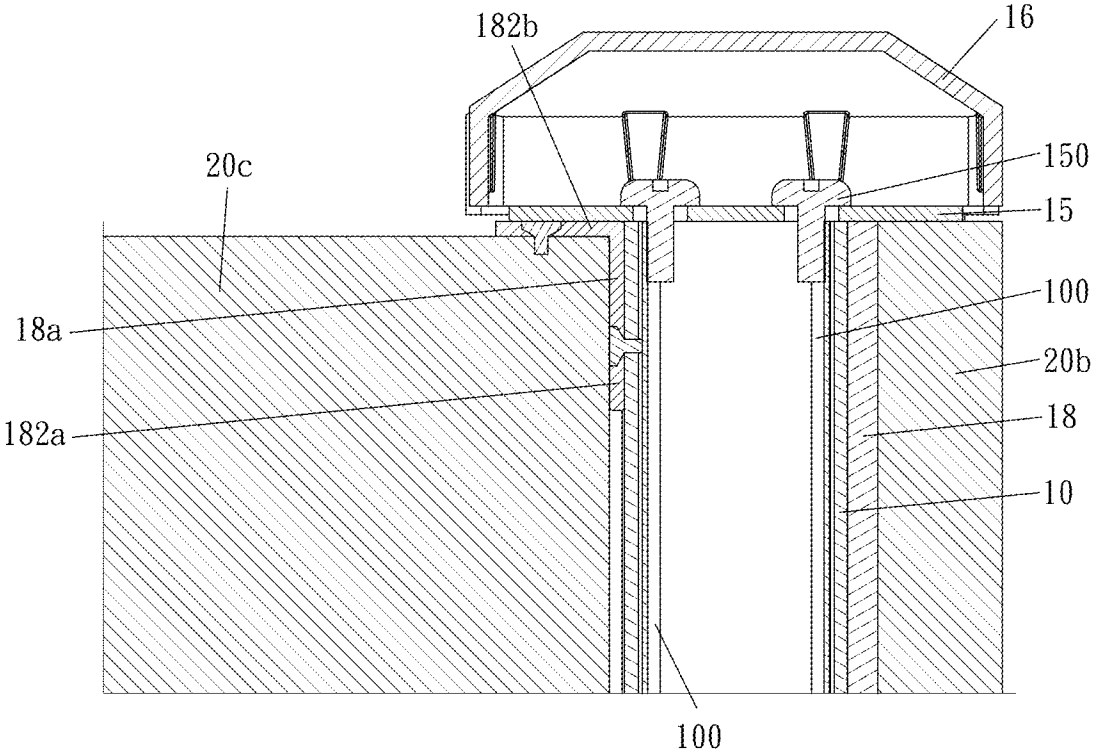
FIG. 7 is a section view of 7*s*-7*s* of FIG. 6.

With reference to FIGS. 5, 6 and 7, the cross bar 20*a* can be assembled in a manner of the above-mentioned FIGS. 1~4 if the cross bar 20*a* is an aluminum tube, i.e. pushing the end part of the cross bar 20*a* directly into the notch 12 and the combining slot 11 to buckle and position with the two buckle parts 130. If the cross bar 20*b* is a large piece of glass, at the time of combining with the vertical post 10, a connecting base 18 can be fitted inside the combining slot 11. The middle of connecting base 18 is defined with a gap 180 facing outward, thereby providing the end part of the cross bar 20*b* to be embedded into the gap 180 to be positioned. The left and right sides of the connecting base 18 are configured with the clamping slots 181 providing the opening edges 120 of the notch 12 to be embedded into to fix the connecting base 18. If the cross bar 20*c* is a wooden board (as shown in FIGS. 6, 7), the connecting base 18*a* can be a L-shaped plate, wherein a longitudinal end surface 182*a* of the L-shaped base 18*a* is fixed with the upper inner wall of the combining slot 11 via a screw piece, the other transverse end surface 182*b* is secured with the top surface of the end part of the cross bar 20*c* reaching into the combining slot 11 extending into the connecting slot 11 via a screw piece, and the left and right sides of the cross bar 20*c* are buckled and fixed by the two buckle parts 130.

According to the above descriptions, the configuration of installing the combining slot 11, the notch 12, the clamping plate 13, the buckle part 130, the spacer plate 14 and the upper stop plate 15 enable the assembly between the cross bar 20 and the vertical post 10 to be easier and save time. Moreover, the configuration of installing the connecting base 18 and the fixation of the vertical post enable the cross bar 20*b*, 20*c* having different material to be combined with the vertical post 10, and therefore the vertical post 10 is suitable for the assemble of the cross bar having different materials.

In summary, the present invention meets the requirements of novelty, inventiveness and practical applicability, and therefore an application for patent is hereby filed according to the law. Your examination and approval will be highly appreciated.

What is claimed is:

1. A vertical post structure of a fence, the fence comprising:

at least two vertical posts; and at least one cross bar having two ends, the two ends of said cross bar being connected to the vertical post;

wherein one side of the vertical post facing the cross bar has a combining slot extending axially, an outer side of the combining slot facing the vertical post having a notch extending axially, an inner wall of the combining slot and the two sides near to the notch respectively extending obliquely toward an interior of the combining slot and a projection range of the notch to form a clamping board, wherein the clamping board being arranged left and right and having a buckle part on a tail end, the two buckle parts each having a fixed end and a free end, an elastic clamping force existing between the two buckle parts, the elastic clamping force being imparted upon the at least one cross bar when each of the two buckle parts are in contact with the at least one cross bar, the two buckle parts being positioned inside the projection range of the notch; and an upper stop plate being fixed with a top end of the vertical post, having a coverage of covering the projection range of the combining slot;

wherein when configuring two or more than two cross bars, a spacer plate being configured between each two cross bars, the spacer plate being combined and fixed with the notch to be a longitudinal support point of the cross bars and used to cover the notch;

wherein a concave clipping recess being installed on an outer wall of the left and right sides of the spacer plate, the outer walls matching the opening edge of the notch, the front ends of the two concave clipping recesses being configured with an inclined taper surface, when the spacer plate being combined and positioned with the notch, the taper surface across the opening edge of the notch enabling the opening edge to be embedded into the clipping recess, and further the spacer plate being fixed on the notch.

2. The vertical post structure of the fence of claim 1, wherein the top end of the vertical post above the upper stop plate being fixed with a decorative cover.

3. The vertical post structure of the fence of claim 1, wherein the cross bar being a wooden board, a L-shaped base being fixed inside the combining slot, a longitudinal end surface of the L-shaped connecting base being secured with an inner wall of the combining slot, another transverse end surface being secured with a top surface of an end part of the cross bar reaching into the combining slot, and the left and right sides of the cross bar being buckled by the two buckle parts.

4. The vertical post structure of the fence of claim 1, wherein the combining slot, the notch and the clamping board being installed at one side of the vertical post.

5. The vertical post structure of the fence of claim 1, wherein the combining slot, the notch and the clamping board being installed at the two opposite sides or sequentially at the three sides spaced at 90 degrees of the vertical post.

6. The vertical post structure of the fence of claim 5, wherein the notch of the vertical post connecting the cross bar being covered by a cover plate.

7. The vertical post structure of the fence of claim 6, wherein the left and right side outer walls of the cover plate matching the opening edge of the notch being configured with a concave clipping recess, the front ends of the two clipping recesses of the cover plate being configured with an inclined taper surface clamping and being fixed with the opening edge of the notch via the clipping recesses of the cover plate.

8. A vertical post structure of a fence, the fence comprising:

at least two vertical posts; and at least one cross bar having two ends, the two ends of said cross bar being connected to the vertical post;

wherein one side of the vertical post facing the cross bar has a combining slot extending axially, an outer side of the combining slot facing the vertical post having a notch extending axially, an inner wall of the combining slot and the two sides near to the notch respectively extending obliquely toward an interior of the combining slot and a projection range of the notch to form a clamping board, wherein the clamping board being arranged left and right and having a buckle part on a tail end, the two buckle parts each having a fixed end and a free end, an elastic clamping force existing between the two buckle parts, the elastic clamping force being imparted upon the at least one cross bar when each of the two buckle parts are in contact with the at least one cross bar, the two buckle parts being positioned inside the projection range of the notch; and an upper stop plate being fixed with a top end of the vertical post, having a coverage of covering the projection range of the combining slot;

wherein the combining slot, the notch and the clamping board being installed at the two opposite sides or sequentially at the three sides spaced at 90 degrees of the vertical post;

wherein the notch of the vertical post connecting the cross bar being covered by a cover plate;

wherein the left and right side outer walls of the cover plate matching the opening edge of the notch being configured with a concave clipping recess, the front ends of the two clipping recesses of the cover plate being configured with an inclined taper surface clamping and being fixed with the opening edge of the notch via the clipping recesses of the cover plate.

* * * * *